US005659988A

United States Patent [19]

Kim et al.

[11] Patent Number: 5,659,988

[45] Date of Patent: Aug. 26, 1997

[54] DUAL DIRECTIONAL ROTATING DEVICE

[76] Inventors: Kyong Kim Kim; William Soto, both of 50 Thorne Ave., North Massapequa, N.Y. 11758

[21] Appl. No.: 578,419

[22] Filed: Dec. 26, 1995

[51] Int. Cl.[6] ..... A63H 33/40

[52] U.S. Cl. ..... 40/440; 446/218

[58] Field of Search ..... 40/440, 412, 413; D21/93; 446/217, 218, 201

[56] References Cited

U.S. PATENT DOCUMENTS

| | | | |
|---|---|---|---|
| D. 117,260 | 10/1939 | Egerton | D21/93 |
| D. 141,573 | 6/1945 | Debenport | D21/93 |
| 177,155 | 5/1876 | Raffa . | |
| D. 359,099 | 6/1995 | Sugiomoto | D21/93 |
| 454,804 | 6/1891 | Murphy . | |
| 1,268,644 | 6/1918 | Truitt . | |
| 1,559,696 | 11/1925 | Heberling . | |
| 2,797,510 | 7/1957 | McLarty | 40/440 |
| 3,041,765 | 7/1962 | Paar | 446/217 |
| 3,646,695 | 3/1972 | Pfeiffer | 40/440 |
| 5,083,963 | 1/1992 | Lin | 446/217 |

*Primary Examiner*—Robert A. Hafer
*Assistant Examiner*—Jeffrey D. Carlson
*Attorney, Agent, or Firm*—Michael I. Kroll

[57] ABSTRACT

A dual directional rotating device (10) comprising an elongated slender flexible line (12). A wind wheel (14) is provided. A double bearing unit (16) is between the line (12) and the wind wheel (14), to cause the wind wheel (14) to rotate clockwise and counterclockwise on the line (12), depending upon which way wind blows against the wind wheel (14).

1 Claim, 3 Drawing Sheets

DUAL DIRECTIONAL ROTATING DEVICE

BACKGROUND OF THE INVENTION

1. Field of the Invention

The instant invention relates generally to pinwheels and more specifically it relates to a dual directional rotating device.

2. Description of the Prior Art

Numerous pinwheels have been provided in prior art. For example, U.S. Pat. No. 177,155 to Raffa; U.S. Pat. No. 454,804 to Murphy; U.S. Pat. No. 1,268,644 to Truitt and U.S. Pat. No. 1,559,696 to Heberling all are illustrative of such prior art. While these units may be suitable for the particular purpose to which they address, they would not be as suitable for the purposes of the present invention as heretofore described.

RAFFA, PASQUALE

TOY WIND WHEEL

U.S. Pat. No. 177,155

In a toy wind-wheel, the flexible vanes attached with their ends to the radial arms in such a manner that the force of the wind striking either side of the vanes will cause the wheel to revolve in one direction, substantially as set forth.

MURPHY, WILLIAM

TOY PINWHEEL

U.S. Pat. No. 454,804

The combination, with a screw-threaded rod, of a pinwheel fitted to revolve loosely upon and travel along the rod, substantially is the manner and for the purpose herein set forth.

TRUITT, OWEN K.

PINWHEEL

U.S. Pat. No. 1,268,644

A pinwheel comprising a face element. A back element is foldable from the outer edges inwardly over the face element. Means for securing the folded portions of the back element together at a point intermediate the outer edges of the face element. A blank is disposed upon the face element and embraced by the folded portions of the back element, when they are secured together.

HEBERLING, JOHN

PINWHEEL

U.S. Pat. No. 1,559,696

A wind wheel blank having a central portion and three symmetrically arranged blade forming elements, each connected to the central portion by a reduced neck. The blade forming elements have two oppositely extending arms. The distance between the extreme end of one arm and the center of the central portion is greater than the distance between the extreme end of the other arm and the center of the central portion. The elements are separated by recesses whose mouths lie entirely to one side of straight lines drawn from the center of the central portion to those outermost portions of the blade forming elements, which are to form the tips of the blades. The recesses are of such shape that when the shorter arms are curved over the longer arms, the resisting surfaces formed by such shorter arms will extend less than one half of the lengths of the blades.

SUMMARY OF THE INVENTION

A primary object of the present invention is to provide a dual directional rotating device that will overcome the shortcomings of the prior art devices.

Another object is to provide a dual directional rotating device that contains a wind wheel with dual bearings, which will cause the wind wheel to rotate clockwise or counterclockwise on a cord depending upon which way the wind blows against the wind wheel.

An additional object is to provide a dual directional rotating device in which the dual bearings will allow a plurality of wind wheels to be strung along the cord, for decorative appearances thereof.

A further object is to provide a dual directional rotating device that is simple and easy to use.

A still further object is to provide a dual directional rotating device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
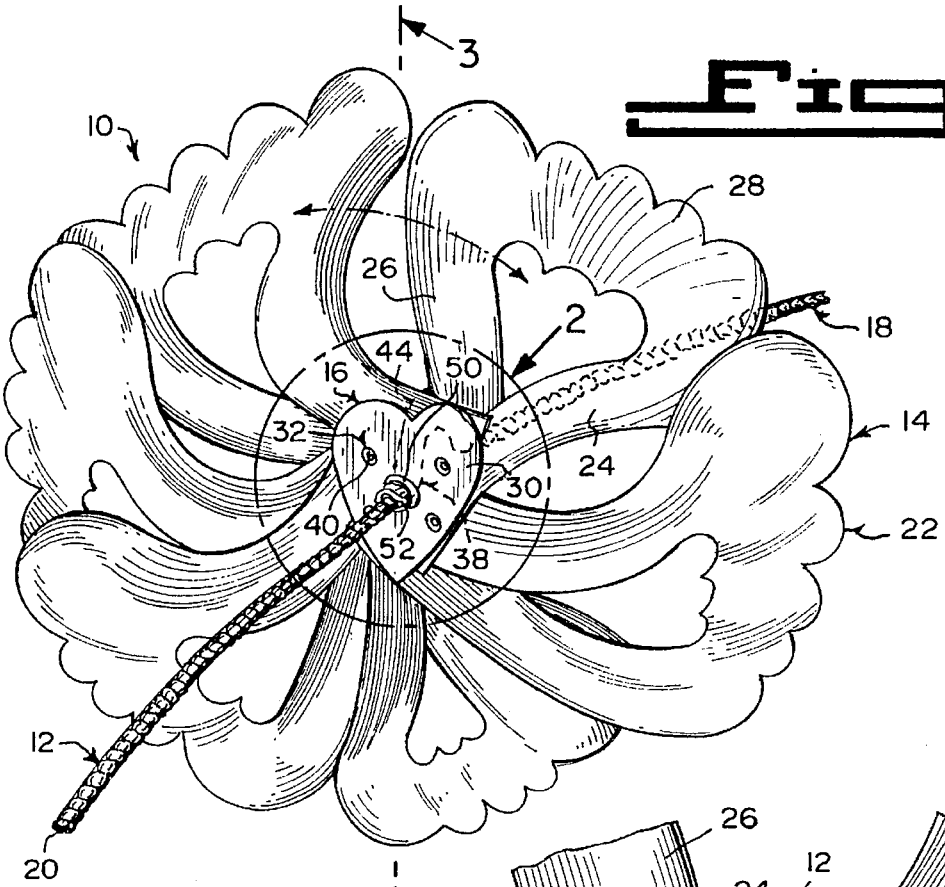
FIG. 1 is a perspective view of the instant invention.
Figure 2:
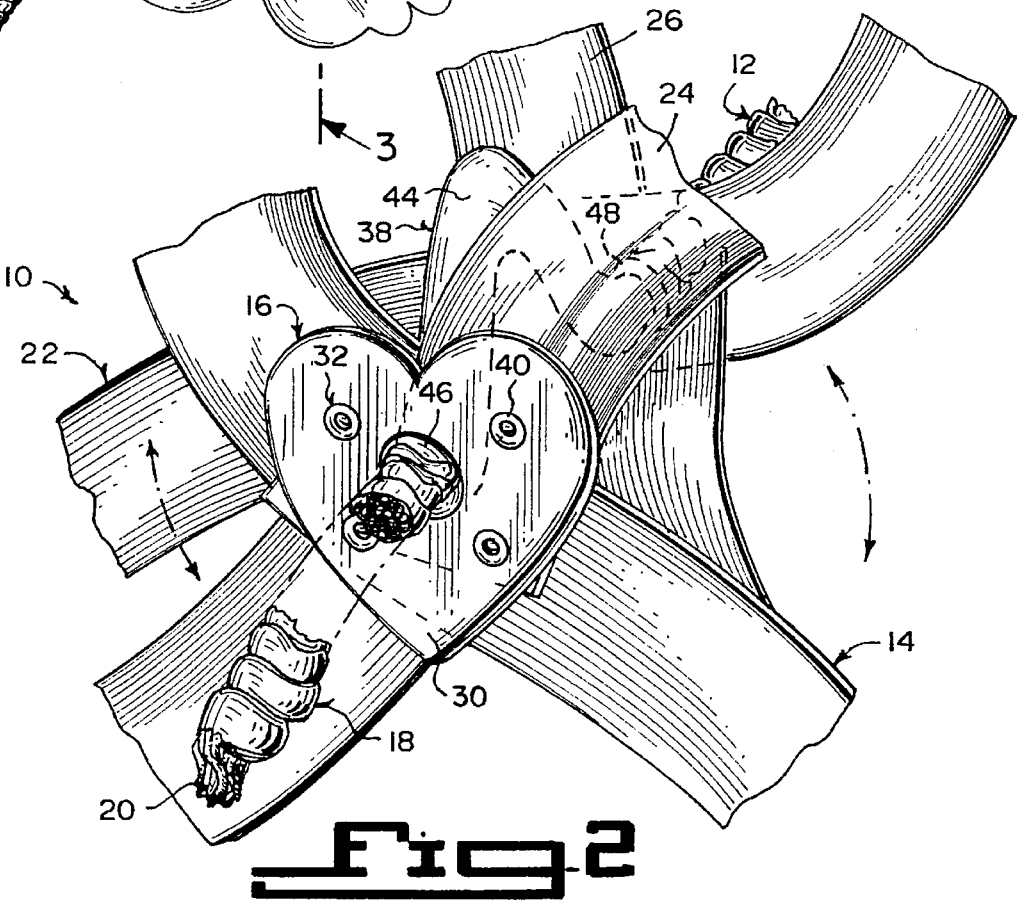
FIG. 2 is an enlarged perspective view of the center area as indicated by arrow 2 in FIG. 1.
Figures 3, 4:
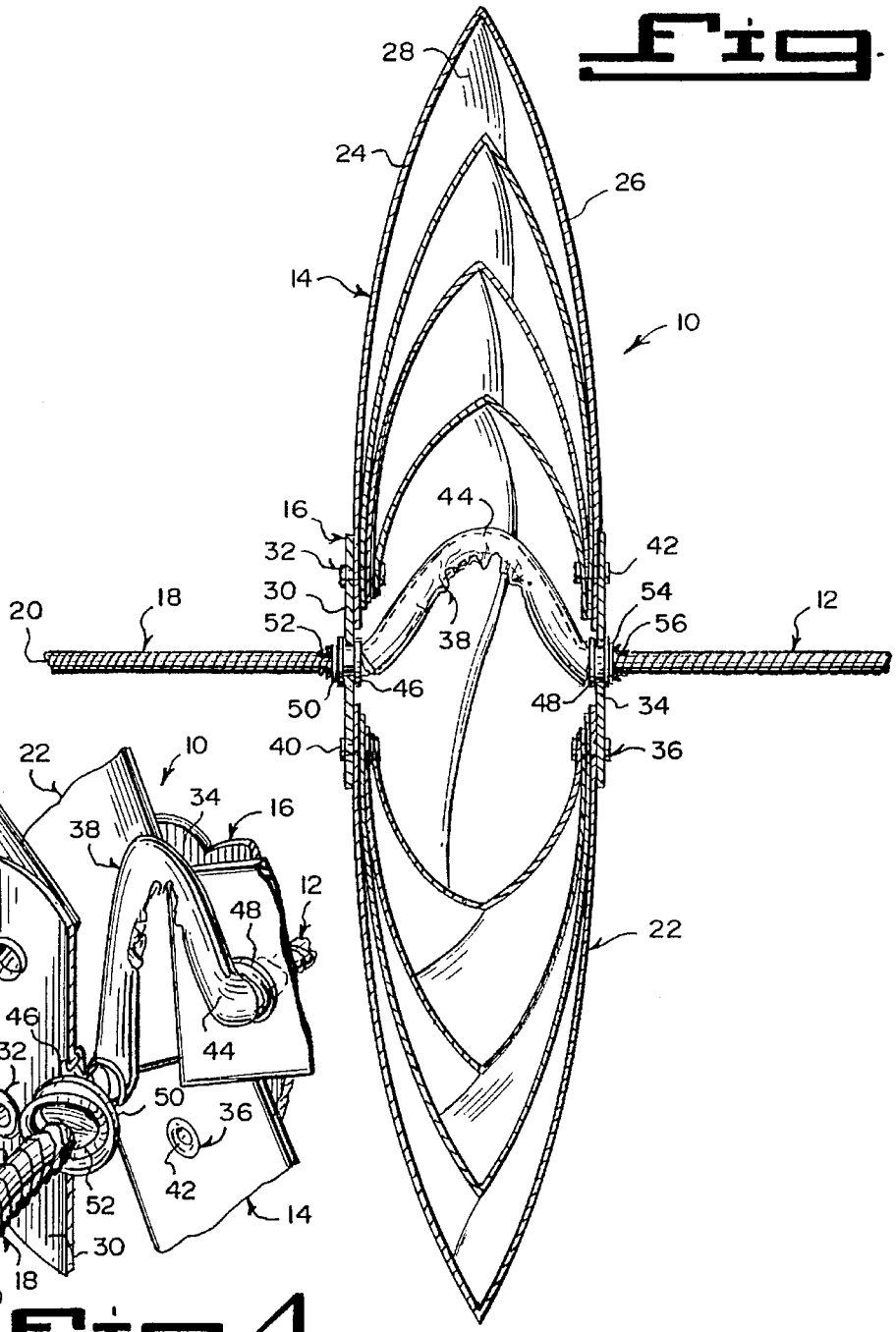
FIG. 3 is an enlarged cross sectional view taken along line 3—3 in FIG. 1.
FIG. 4 is an enlarged perspective view similar to FIG. 2 with parts broken away and in section, showing internal structural details in greater detail.

Turning now descriptively to the drawings, in which similar reference characters denote similar elements throughout the several views, FIGS. 1 through 5 illustrate a dual directional rotating device 10, comprising an elongated slender flexible line 12. A wind wheel 14 is provided. A double bearing unit 16 is between the line 12 and the wind wheel 14, to cause the wind wheel 14 to rotate clockwise and counterclockwise on the line 12, depending upon which way wind blows against the wind wheel 14.

The line 12 is a cord 18, having several strands 20 woven and twisted together. The wind wheel 14 includes a plurality of van assemblies 22. Each van assembly 22 extends radially and between the double bearing unit 16.

Each vane assembly 22 consists of a first thin flat blade 24, a second thin flat blade 26 and an interconnecting integral thin flat cross-piece 28 between outer ends of the first and second thin flat blades 24 and 26.

The double bearing unit 16 contains a first flat hub member 30, having a central aperture, so that the line 12 can extend therethrough. Components 32 are for securing inner ends of the first thin flat blades 24 to the first flat hub member 30. A second flat hub member 34 has a central aperture therethrough, so that the line 12 can extend therethrough. Components 36 are for securing inner ends of the second thin flat blade 26 to the second flat hub member 34. An element 38 within the wind wheel 14 is for spacing the first flat hub member 30 away from the second flat hub member 34, so as to separate the first thin flat blades 24 away from the second thin flat blades 26.

The first securing components 32 are a plurality of eyelet connectors 40. Each eyelet connector 40 extends through the inner end of each first thin flat blade 24 and the first flat hub member 30.

The second securing components 36 are a plurality of eyelet connectors 42. Each eyelet connector 42 extends through the inner end of each second thin flat blade 26 and the second flat hub member 34. The spacing element 38 is a V-bent sleeve 44 on the line 12 between the first flat hub member 30 and the second flat hub member 34.

The double bearing unit 16 further includes a first eyelet bushing 46 in the central aperture of the first flat hub member 30. A second eyelet bushing 48 is in the central aperture of the second flat hub member 34.

A first washer 50 is on the line 12 adjacent the first flat hub member 30. A first crimped eyelet 52 is on the line 12 adjacent the first washer 50. A second washer 54 is on the line 12 adjacent the second flat hub member 34. A second crimped eyelet 56 is on the line 12 adjacent the second washer 54, so as to maintain the wind wheel 14 in a rotative position on the line 12.

Figure 5:
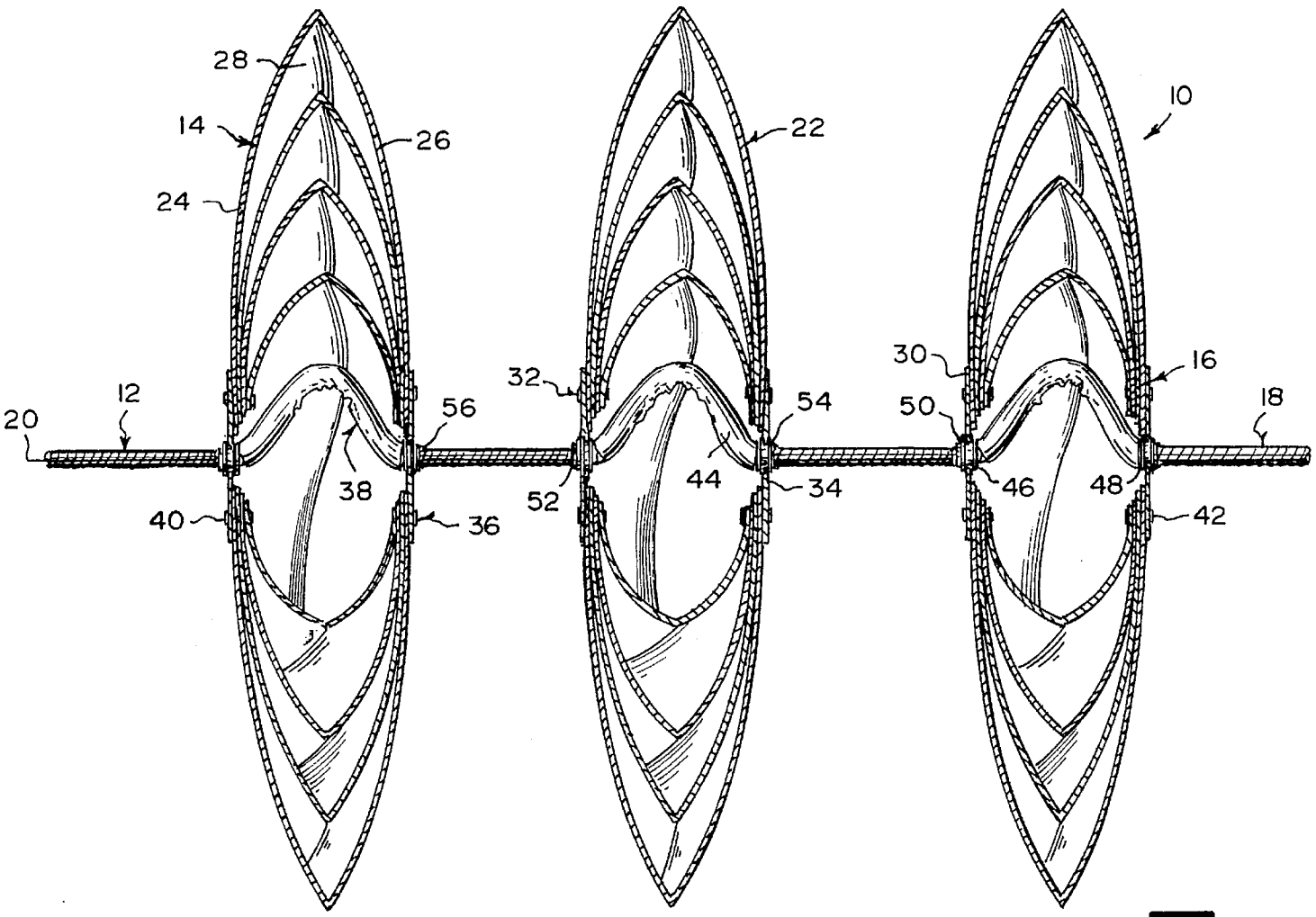
FIG. 5 is a cross sectional view similar to FIG. 3, showing a plurality of the vane assemblies strung along the cord.

In FIG. 5, a plurality of the wind wheels 14 can be strung along the line 12 in spaced apart rotative positions. Each wind wheel 14 utilizes respectively the first washer, the first crimped eyelet 52, the second washer 54 and the second crimped eyelet 56 on the line 12.

The cord 18 can be made in a variety of colors, while each vane assembly 22 can also be made in a different color. The V-bent sleeve 44 is normally plastic, while each vane assembly 22 can be fabricated out of plastic, cardboard, light metal or heavy paper. The eyelet connectors 40 and 42, the eyelet bushings 46 and 48, the washers 50 and 54 and the crimped eyelets 52 and 56 can be fabricated out of plastic or metal.

LIST OF REFERENCE NUMBERS

10 dual directional rotating device
12 elongated slender flexible line of 10
14 wind wheel of 10
16 double bearing unit of 10 between 12 and 14
18 cord for 12
20 strands in 18
22 vane assembly of 14
24 first thin flat blade of 22
26 second thin flat blade of 22
28 thin flat crosspiece of 22
30 first flat hub member of 16
32 first securing component between 24 and 30
34 second flat hub member of 16
36 second securing component between 26 and 34
38 spacing element
40 eyelet connector of 32
42 eyelet connector of 36
44 V-bent sleeve for 38
46 first eyelet bushing in 30
48 second eyelet bushing in 34
50 first washer on 12
52 first crimped eyelet on 12
54 second washer on 12
56 second crimped eyelet on 12

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A dual directional rotating device comprising:

a) an elongated slender flexible line;

b) a wind wheel mounted on said line for rotation;

c) a double bearing unit between said line and said wheel comprising a first flat hub member and a second flat hub member spaced from each other, each hub member having a central aperture through which said line passes, to cause said wind wheel to rotate clockwise and counterclockwise on said line, depending upon which way wind blows against said wind wheel;

d) means within said wind wheel for spacing said first flat hub member away from said second flat hub member comprising a V-shaped sleeve through which said line passes;

e) said wind wheel including a plurality of vane assemblies extending radially and between said flat hub members, each vane assembly comprising a first thin flat blade, a second thin flat blade, and an interconnecting integral thin flat cross-piece between outer ends of said first and second flat blades, the inner end of the first thin flat blade being secured to the first flat hub member and the inner end of the second thin flat blade being secured to the second flat hub member, each of the inner ends of the thin flat blades being secured to a hub member by an eyelet connector extending through both the inner end of the thin flat blade and the flat hub member; and f) each central aperture in each hub member having an eyelet bushing therethrough, a washer adjacent said eyelet bushing, and a crimped eyelet adjacent said washer on the opposite side from said eyelet bushing.

* * * * *